United States Patent [19]

Ando

[11] 4,113,410

[45] Sep. 12, 1978

[54] LIQUID-SEALED TYPE VACUUM PUMP

[75] Inventor: Sumio Ando, Osaka, Japan

[73] Assignee: Otsuka Nutrition Research Institute Inc., Osaka, Japan

[21] Appl. No.: 661,077

[22] Filed: Feb. 25, 1976

[30] Foreign Application Priority Data

| | | | |
|---|---|---|---|
| Feb. 25, 1975 | [JP] | Japan | 50-26257[U] |
| Feb. 25, 1975 | [JP] | Japan | 50-26258[U] |
| Aug. 6, 1974 | [JP] | Japan | 49-89958 |
| Aug. 26, 1974 | [JP] | Japan | 49-97728 |
| Feb. 25, 1975 | [JP] | Japan | 50-23618 |
| Aug. 26, 1975 | [JP] | Japan | 50-103193 |

[51] Int. Cl.[2] ..... F04B 41/00

[52] U.S. Cl. ..... 417/502; 417/503; 417/534

[58] Field of Search ..... 417/53, 313, 502, 503, 417/243, 254, 534, 372; 418/96, 97; 92/83

[56] References Cited

U.S. PATENT DOCUMENTS

| | | | |
|---|---|---|---|
| 3,027,651 | 4/1962 | Nerge | 417/243 |
| 3,149,775 | 9/1964 | Pagano | 417/313 |
| 3,233,554 | 2/1966 | Huber et al. | 417/534 X |
| 3,327,936 | 6/1967 | Rollinger | 418/96 X |
| 3,421,688 | 1/1969 | Spooner | 418/96 |
| 3,751,191 | 8/1973 | Mott et al. | 417/313 |

FOREIGN PATENT DOCUMENTS

| | | | |
|---|---|---|---|
| 1,526,584 | 12/1970 | Fed. Rep. of Germany | 417/313 |
| 661,031 | 6/1938 | Fed. Rep. of Germany | 418/96 |
| 1,163,486 | 2/1964 | Fed. Rep. of Germany | 418/96 |

*Primary Examiner*—Carlton R. Croyle
*Assistant Examiner*—Edward Look
*Attorney, Agent, or Firm*—Sughrue, Rothwell, Mion, Zinn and Macpeak

[57] ABSTRACT

A water-sealed type vacuum pump characterized in that a suction pipe connected to a chamber to be vacuumized above liquid containing cylinders, which are provided at the lower portion thereof with a mechanism for alternatively increasing and decreasing a pressure of liquid, is open to a lower portion of a suction chamber through an intake valve, the liquid containing cylinders each being interiorly provided with a valve means so as to discharge the liquid through the valve means when the liquid pressure is high while to suck air from the suction pipe when the liquid pressure is low, and a liquid circulating device is provided to return the liquid to be discharged thereby effecting stabilized suction and discharge, the liquid containing cylinders being further interiorly provided with a fluid cooling device to cool and liquidize the sucked air.

13 Claims, 15 Drawing Figures

101
103
109
110
111
112
113
114
115
116
117
118
119
120
121
122
123
124
125
126
152
166
171
189
192
194
196
197
198
199
57

FIG 14
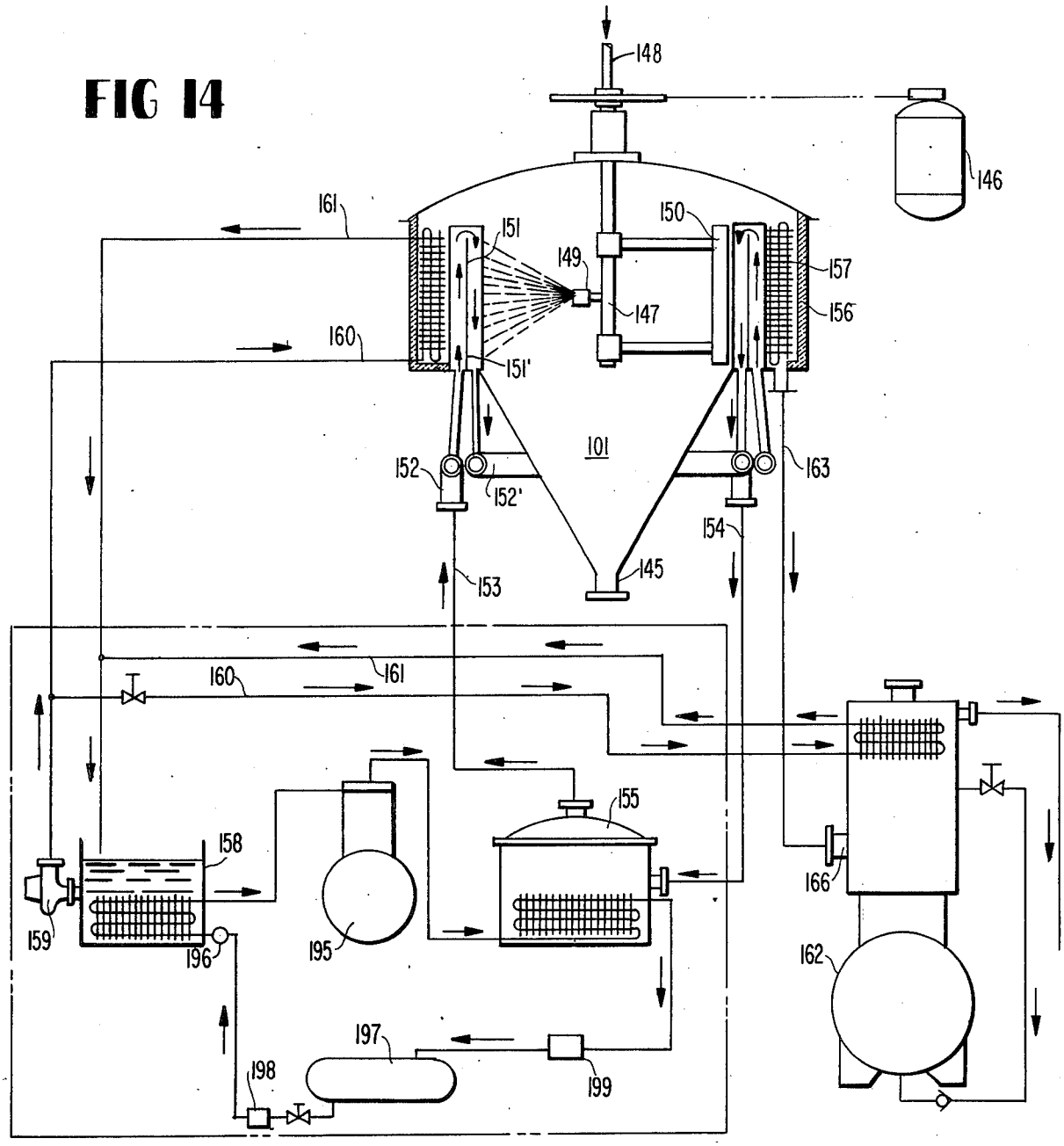
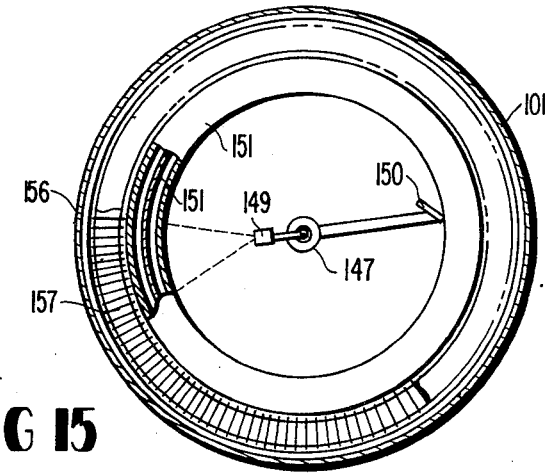
FIG 15

LIQUID-SEALED TYPE VACUUM PUMP

BACKGROUND OF THE INVENTION

This invention relates to water-sealed type vacuum pumps and more specifically, to a vacuum pump in which a pump is connected to a suction pipe and air is sucked and exhausted by suction and discharge actions of a liquid tank.

Vacuum pumps which have heretofore been used in vacuum drying apparatus include vapor ejector pumps, oil rotating vacuum pumps, and water-sealed type vacuum pumps. In the case of the vapor ejector pump, a multi-stage ejector must be used to obtain a carry-over pressure as desired and a great amount of vapors are used up, naturally resulting in an increase of drying cost. In the case of the oil rotating pump, the vapor is sucked and hence the performance is materially lowered such as by deterioration of oil and decrease in exhaust velocity. In order to eliminate these drawbacks, the pump and oil tank are heated by vapor or electrical heat to excessively heat the vapor into a non-condensed gas, which is discharged to prevent water from being mixed with a oil. In the conventional water-sealed type vacuum pumps, the carry-over pressure as desired cannot be obtained even if the circulating water temperatures should be decreased to about 5° C, with the result that the low temperature vacuum drying could not be accomplished. Further, conventional vacuum pumps suffer from various disadvantages. For example, since deaerating is accomplished while directly sucking and exhausting air itself to be deaerated, it is extremely difficult to obtain a high degree of vacuum due to the presence of mechanical clearance of the pump. Also lubricating oil is emulsified with the water content under suction to hamper the lubricating action. Also if entry of a large amount of water is made during suction, phenomena such as water hammer and knocking occurs and a cumbersome starting operation is involved.

SUMMARY OF THE INVENTION

In view of the disadvantages of water-sealed type vacuum pumps as compared to mechanical vacuum pumps i.e., if water (or liquids other than water such as process fluid may also be used as the seal liquid) is used as the seal liquid, exhaust velocity per required electric power is small or carryover pressure is not obtained, the present invention has the following objects.

It is an object of this invention to provide a vacuum pump which can utilize the suction and discharge actions of liquid to obtain a high degree of vacuum extremely easily and efficiently.

It is a further object of the invention to maintain a vacuum within liquid containing cylinders by the provision of a circulating pipe mounted on a discharge valve.

It is another object of the invention to cool air (saturated vapor) sucked into a suction chamber cylinder while rotating the air by heat exchanging spiral fins to form it into condensed water thereby imparting a stabilized high degree of vacuum to a sucked exhaust of condensable gas.

It is yet another object of the invention to maintain the interior of a sucked liquid containing external cylinder at a low temperature by the provision of cooling bellow-like pipes thereby removing the drawback with respect to prior art water-sealed type vacuum pumps, in which the carry-over pressure increases as the seal water temperature rises, and obtaining vacuum almost close to complete vacuum.

It is still another object of the invention to further facilitate suction and exhaust actions by employment of heat exchanging, in which liquids in a liquid tank are circulated and cooled by a circulating pipe having a check valve, to thereby obtain a high degree of vacuum.

It is a further object of the invention to provide a vacuum pump utilizing liquids, wherein an intake valve in a suction opening which provides a communication between the liquid containing external cylinder and the liquid tank is made of a floating material and a flow pressure plate is provided at the foremost end thereof, whereby when the intake valve is opened, a flow pressure due to a downward flow of water from the liquid containing external cylinder acts on the flow pressure plate to provide a smooth and easy operation of opening the intake valve, and during exhaust stroke of the piston, a rising flow of water from the liquid tank to the liquid containing internal cylinder acts on the flow pressure plate and the intake valve may rapidly be closed by buoyancy of the valve itself to accurately and effeciently open and close the intake valve, thus obtaining a high degree of vacuum.

It is another object of the invention to provide an extremely simple construction by forming the intake valve of a floating material to reduce the weight of the valve with the provision of a small balancing spring of the intake valve.

It is another object of the invention to provide an air cushion chamber within the liquid containing cylinder to prevent water hammer from occurring during the exhaust stroke because of introduction of a cooling liquid into the liquid tank through the circulating pipe.

It is final object of the invention to provide an air separating chamber, which is interiorly provided with a floater, an air exhaust port and an opening and closing valve and which is exteriorly provided with a discharged liquid pipe, to achieve a stabilized air exhaust.

The present invention provides an arrangement wherein liquids within the liquid containing cylinder is sucked and discharged by a suction and discharge mechanism positioned at the lower part of the cylinder and utilization of operation of sucking and discharging the liquid is made to deaerate the suction chamber, and therefore, and complete vacuum may very easily be obtained. In addition, the only mechanism required therefor is a mechanism for sucking and discharging the liquid. Consequently, no complicated mechanism is required as in the prior arts, and the construction is very simple without involving a possible failure, thus enabling large sized systems to be easily designed. Moreover, according to the present invention, it is not necessary to use lubricating oil as is required in prior arts, and hence, the present invention provides various advantages, which cannot be achieved by prior art vacuum pumps, such that the operation is not hampered by emulsification with water; water hammer and knocking due to entry of a large quantity of water can not possibly occur; smooth and accurate operation may be secured; starting operation can be achieved without trouble; and the utilization range is extremely wide.

BRIEF DESCRIPTION OF THE DRAWINGS

These objects, features and advantages of the present invention will appear more fully hereinafter from a consideration of the following description taken in connection with the accompanying drawings, FIGS. 1 through 8 wherein several specific embodiments are illustrated, in which:

FIGS. 9 to 15 illustrate vacuum treatment systems for food or the like, respectively, to which the present pump can be effectively applied.

DETAILED DESCRIPTION OF PREFERRED EMBODIMENTS

Figure 1:
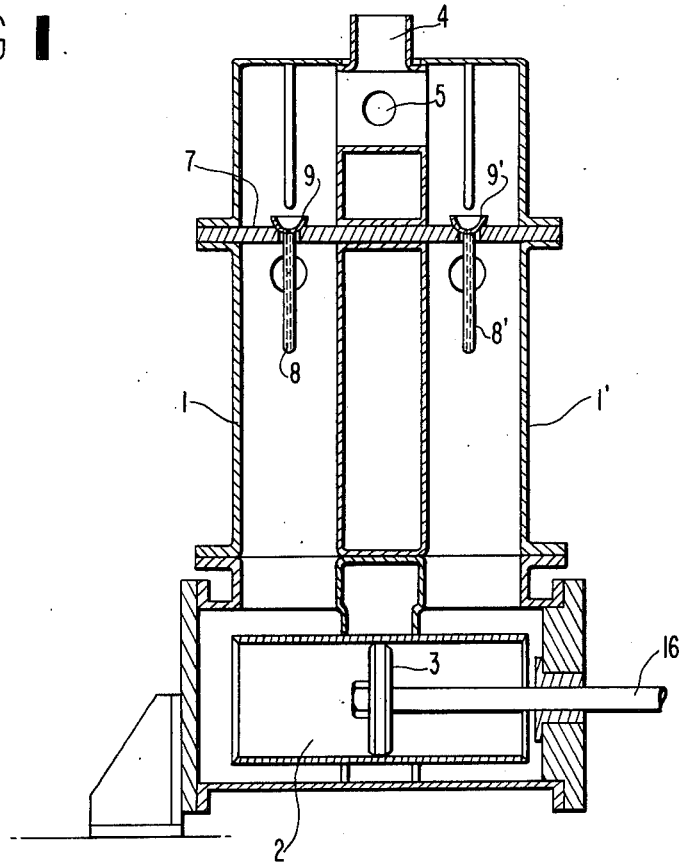
FIG. 1 is a partially cutaway front elevation showing one embodiment according to the present invention.
Figure 2:
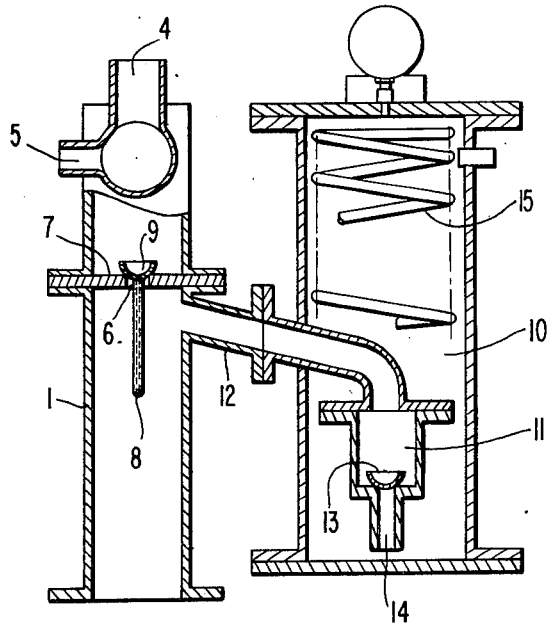
FIG. 2 is a sectional view showing a principal part of FIG. 1.

Referring now to FIGS. 1 and 2, which illustrate one embodiment according to the present invention, there are shown a pair of left and right liquid containing cylinders 1 and 1' the upper ends of which are placed in communication with each other while lower ends are placed in communication through a cylinder 2. A piston 3 is closely fitted in the cylinder 2 to define the pair of left and right liquid containing cylinders 1 and 1'. A piston rod 16 is reciprocated by a suitable mechanism (not shown). The communicating portion at the upper end is provided with an air exhaust port 4 at the top thereof and a water discharge port 5 at the side thereof.

Slightly below the communicating portion between the liquid containing cylinders 1 and 1' are mounted partition walls 7, each being formed with a discharge port 6 integrally formed with a fine circulating pipe 8 and fitted with a discharge valve 9. The valve 9 is opened under liquid pressure only when liquids within the liquid containing cylinders are discharged. A suction pipe 12 is provided at the lower part of the partition wall 7 and is connected to both of the liquid containing cylinders 1 and 1'. The suction pipe 12 communicates with a small chamber 11 located below a suction chamber 10. The small chamber 11 has a communicating port 14 formed at the lower end thereof with an intake valve 13 fitted therein.

The suction chamber 10 is designed so that the upper end portion thereof may be connected with a desired vacuum chamber, for example, such as a vacuum drying chamber for food, and a helical cooling water pipe 15 is interiorly provided at the upper part of the suction chamber to cool and liquidize high temperature suction air.

With the above-mentioned construction of the present invention, when the upper part of the suction chamber 10 is connected, for example, with the vacuum drying chamber for food and the piston 3 is allowed to be resiprocated within the cylinder 2, the liquids within the pair of left and right liquid containing cylinders 1 and 1' are alternately taken in and discharged through the intake valve 13 and the discharge valve 9, respectively.

That is, when the piston 3 is moved slidably rightwards, the liquid within the left-hand liquid containing cylinder 1 is sucked into the cylinder 2 thereby forming a vacuum in the upper portion of the cylinder 1. At the same time the liquid and air within the suction chamber 10 is sucked into the liquid containing cylinder 1 from the suction pipe 12 through the intake valve 13.

Also as the piston is slidably moved rightwards, a part of the liquid in the right-hand liquid containing cylinder 1', along with the air contained therein, causes the discharge valve 9' to open. As a result, the liquid is discharged outside the partition wall 7, whereas the air is discharged through the exhaust port 4. The liquid will overflow at a level higher than the water discharge port 5.

When the piston 3 is subsequently slidably moved leftwards, the liquid and air sucked into the left-hand liquid containing cylinder 1 causes the discharge valve 9 to open. A vacuum forms just below partition 7 in liquid containing cylinder 1 and at the same time the suction pipe 12 sucks the liquid and air within the suction chamber 10 through the intake valve 13. This cycle of operation may be repeated so that the food vacuum chamber is gradually deaerated. In this case, the circulating pipe 8 positioned at the discharge valve 9 serves to return a part of liquids expelled under pressure outside the partition wall 7 to maintain the interior of the liquid containing cylinder to be vacuum, and the cooling pipe 15 in the suction chamber 10 is provided to cool and liquidize the high temperature air.

While the pair of left and right liquid containing cylinders have been provided in the above-mentioned embodiment in order to fully utilize the reciprocating motion of the piston, it will be understood that a single cylinder may of course be provided. In addition, it is to be understood that suction and exhaust mechanism used with the liquid containing cylinders are not limited to a piston, and liquids used may include water, oil, sulfuric acid, etc. in accordance with the purpose of use.

Figure 3:
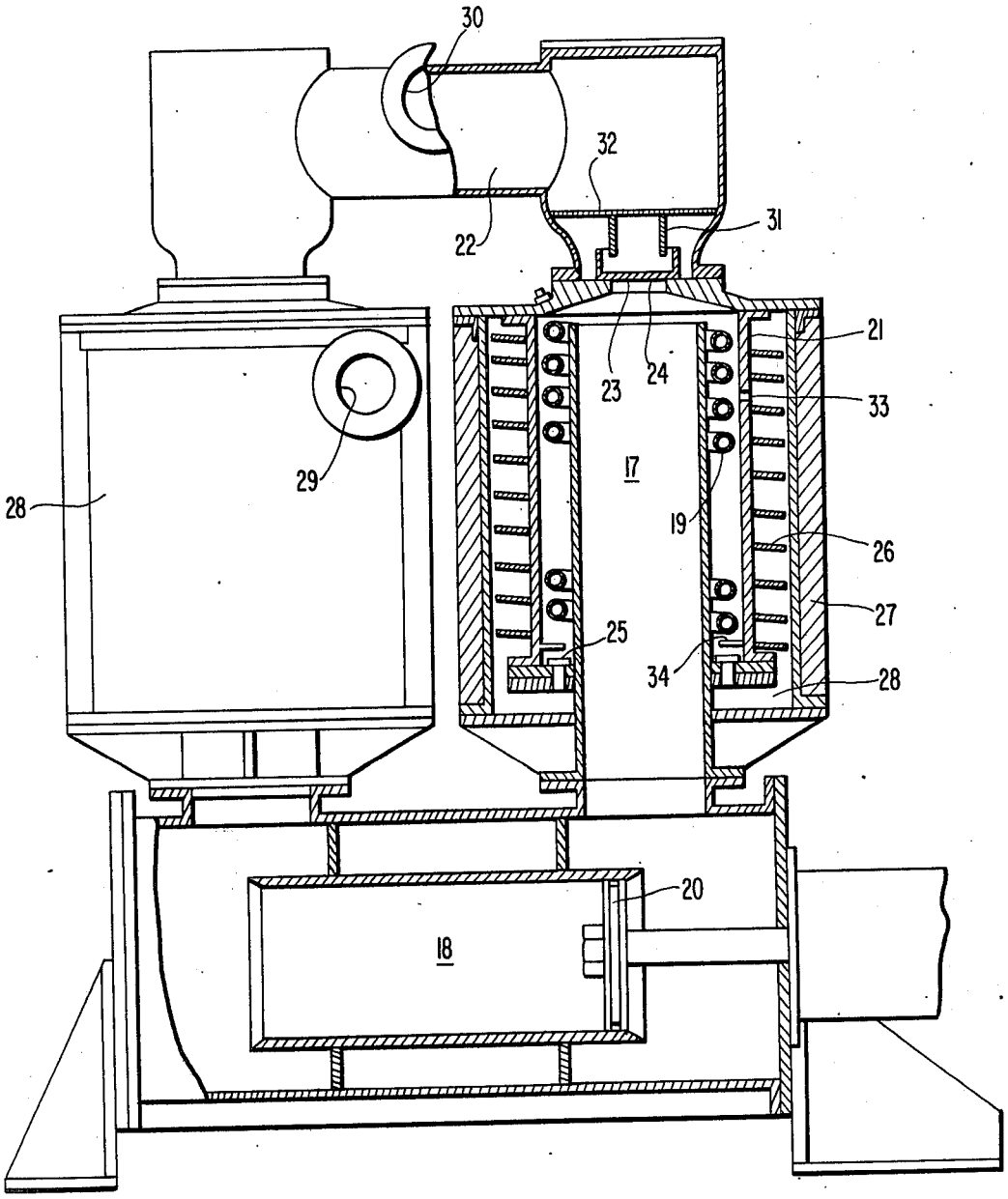
FIG. 3 is a partially cutaway front elevation showing another embodiment according to the invention.
Figure 4:
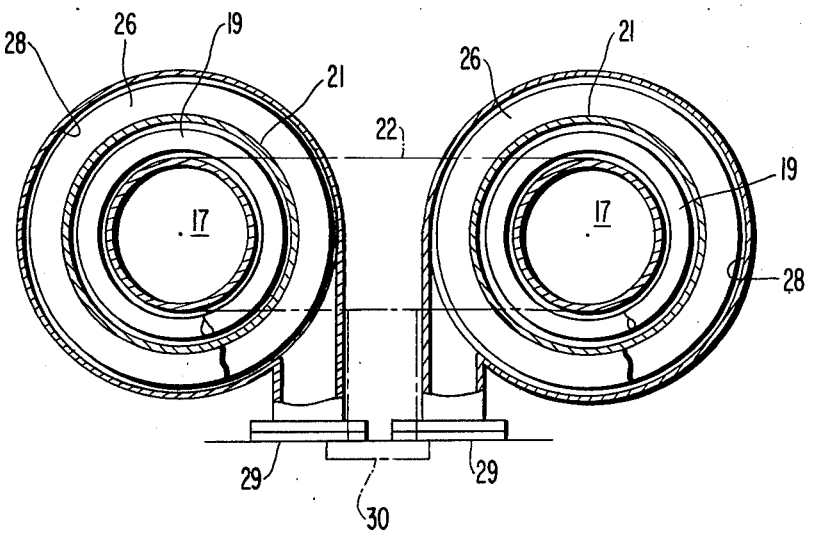
FIG. 4 is a sectional view showing a principal part of FIG. 3.

Next, referring to FIGS. 3 and 4, which illustrate another embodiment, there are shown a pair of left and right liquid containing internal cylinders 17 and 17' having upper ends which are open and lower ends which are in communication through a cylinder 18. In the other peripheral surface at the upper part of the liquid containing internal cylinders there are provided cooling bellow-like pipes 19 connected with a freezer. Fitted within the cylinder 18 is a piston 20 to be reciprocated by a suitable mechanism so that the liquids within the cylinder 18 may be sucked and discharged to alternately suck and discharge the liquids within the liquid containing internal cylinders 17 and 17'.

Liquid containing external cylinders 21 and 21' are positioned externally of the upward portions of the aforementioned liquid containing internal cylinders 17 and 17'. The upper end portions of the external cylinders communicate with each other through a communicating cylinder 22. A water discharge valve 24 with a small opening 23 is mounted at the connection of each outer cylinder 21 and 21' with the communicating cylinder 22. A suction valve 25 is mounted at the lower end surface of each of the external cylinders, and heat exchanging spiral fins 26 formed of aluminum or the like are affixed to the outer peripheral surfaces of the external cylinders.

The liquid containing external cylinders 21 and 21' are placed in suction chamber cylnders 28 and 28' lined with insulated materials 27. The suction chamber cylinders 28 and 28' are formed with suction ports 29 at the upper ends thereof.

Further, the aforementioned communicating cylinder 22 is formed with an air and water discharge port 30, and at the upper part of the water discharge valve 24 there is provided a liquid-jump preventing plate 32 with a stopper 31 projectively mounted at the lower part thereof. The reference numeral 33 designates a through hole formed in the upper part of the liquid containing external cylinders 21 and 21' to decrease the height of water head, and the numeral 34 designates a stopper of the suction valve 25.

With the above-mentioned construction of the present invention, when the suction port 29 in the suction chamber cylinder 28 is connected, for example, with the food vacuum drying chamber to be vacuumized, and the piston 20 is reciprocated within the cylinder 18, the liquids within the pair of left and right liquid containing internal cylinders and liquid containing external cylinders, 17, 17' and 21, 21' are alternately sucked and discharged through the respective suction valve 25 discharge valve 24.

That is, for example, when the piston 20 is slidably moved rightwards as shown in FIG. 3, the liquid within the left-hand liquid containing internal cylinder 17 is sucked into the cylinder 18 thereby forming a vacuum in the upper portions of the liquid containing internal cylinder 17 and liquid containing external cylinder 21. At the same time the air sucked through the suction port 29 is cooled by the heat exchanging spiral fins 26 of the suction chamber cylinder 28 to partially change it into water drops, which are then sucked into the liquid containing external cylinder 21 from the suction valve 25.

Also, a part of the liquid filled in the liquid containing internal cylinder 17' and liquid containing external cylinder 21' along with air contained therein causes the discharge valve 24 to open when the piston 20 is slidably moved rightwards. As a result, the liquid discharged into the communicating cylinder 22 with the air and excess overflown liquid is discharged through the air and water discharge port 30. When the piston 20 is subsequently slidably moved leftwards, the operation of the two sides reverses.

This cycle of operation may be repeated so that the food drying chamber is gradually deaerated into a vacuum. The small opening 23 positioned at the water discharge valve 24 causes the water-air mixture to be expelled under pressure into the communicating cylinder 22. A part of the liquid returns thereby maintaining the interior of the liquid containing internal cylinder 17 and liquid containing external cylinder 21 in a vacuum condition. The cooling bellow-like pipe 19 positioned in the outer peripheral surfaces of the liquid containing internal cylinder 17 may serve to cool the water temperature down to 5°–10° C to enhance the degree of vacuum to about 0.008 to 0.016 Kg/cm$^2$.

Figure 6:
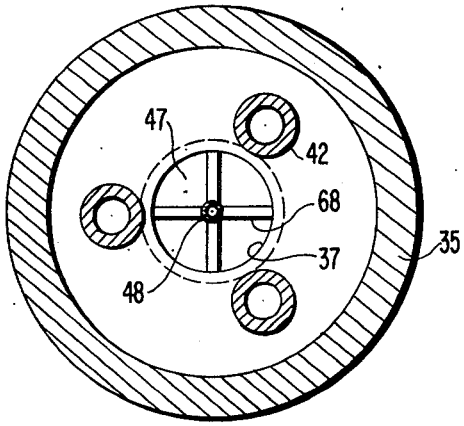
FIG. 6 is a transverse cross sectional top plan view of FIG. 5.
Figure 7:
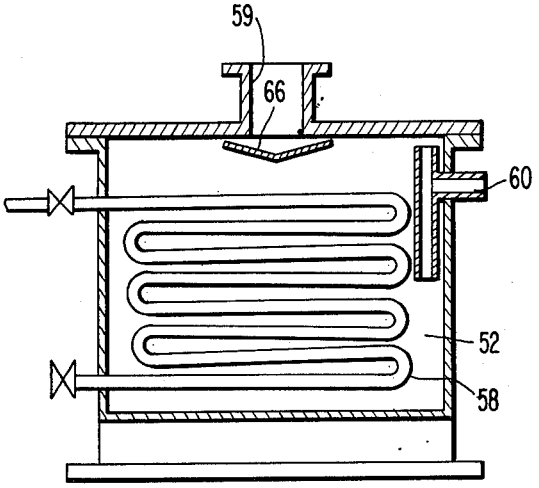
FIG. 7 is a longitudinal sectional side view showing a principal part of FIG. 5.
Figure 5:
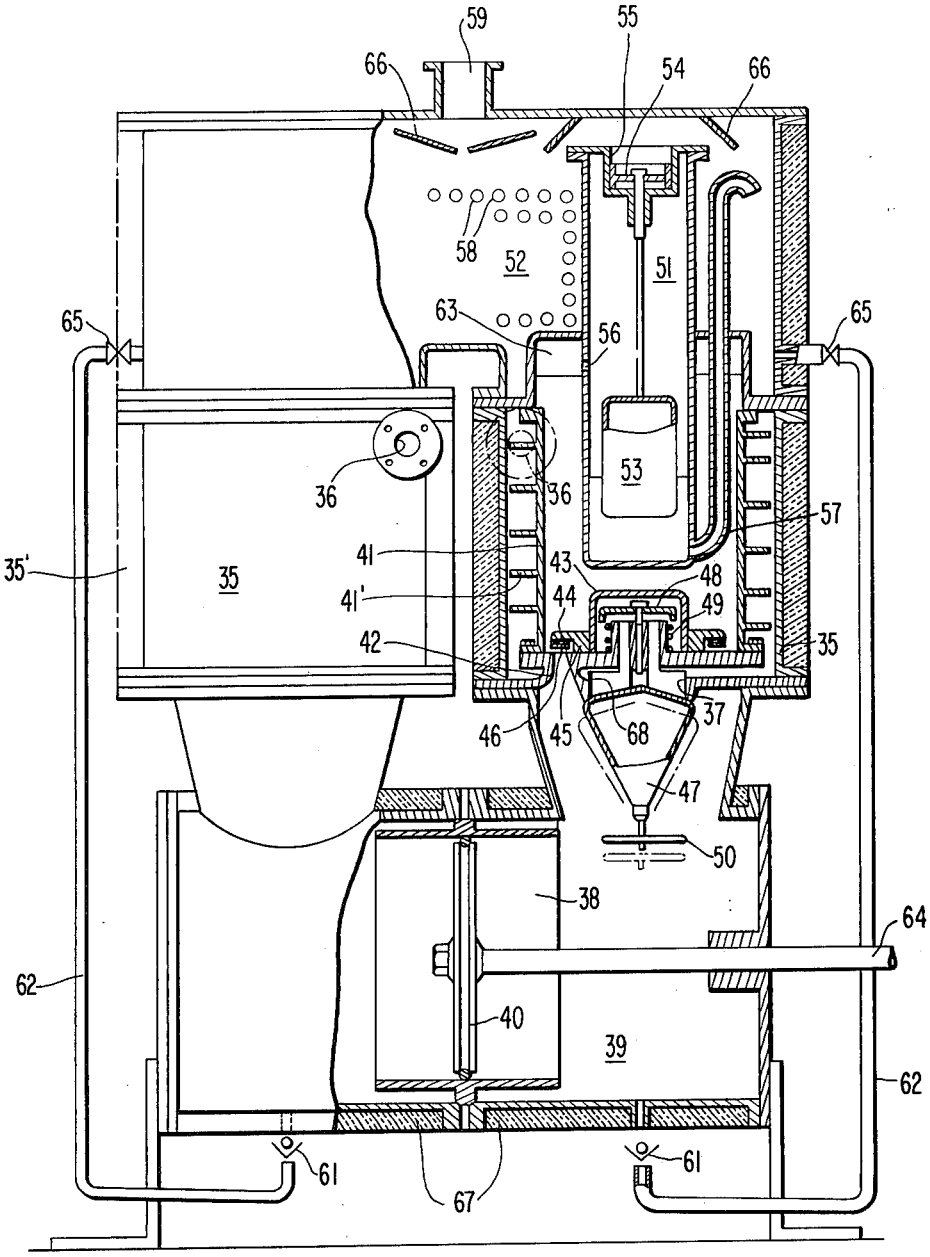
FIG. 5 is a partially cutaway front elevation showing a further embodiment according to the invention.

Further referring to FIGS. 5, 6 and 7, which illustrate a still another embodiment according to the present invention, there are shown a pair of liquid containing external cylinders 35 each having an outer peripheral surface covered with an insulated material 35' and formed with an air intake opening 36 at one side upwardly thereof. At the bottom of each external cylinder 35 there is formed an intake opening 37, which communicate with opposite sides of a liquid tank 39 having a cylinder 38 therein. The liquid tank 39 is divided into two sections by means of a piston 40 fitted within the cylinder 38.

Liquid containing internal cylinders 41, each having heat exchanging spiral fins 41', are placed within the aforementioned liquid containing external cylinders 35. A suitable number of exhaust cylinders 42 are mounted between the bottom of the internal cylinder and the liquid tank 39 to be positioned around the intake opening 37, and a guide cylinder 45 provided with a flange 44 projected upwardly of the exhaust cylinder 42 is secured to a cover cylinder 43 positioned in the central portion of the bottom. An annular exhaust valve 46 fitted movably up and down in the guide cylinder 45 is moved up and down under liquid pressure to open and close the exhaust cylinder 42. A lever 48, mounted on the upper end of an intake valve 47 to open and close the intake opening 37, is upwardly biased by means of a spring 49, and is fitted slidably up and down in the bottom of the liquid containing internal cylinder within the cover cylinder 43. The intake valve 47 is formed of a hollow material or other floating materials, and the bottom thereof has a pressure plate 50 attached thereto.

An air separating chamber 51 has its lower half portion placed interiorly of the liquid containing internal cylinder 41 while its upper half portion extends into a cooling water chamber 52 placed above the pair of liquid containing external cylinders 35. The upper ends of chambers 51 are provided with an air discharge opening 55 that may be opened and closed by an opening-and-closing valve 54 having a floater 53. A middle portion has an overflow opening 56 in communication with the liquid containing internal cylinder 41, and a lower end is provided with a discharge liquid pipe 57, the opposite end of which is open to a cooling water chamber 52. A cooling bellow-like pipe 58 connected to a freezer is provided in the central portion of the cooling water chamber 52 to cool the liquid within the cooling water chamber 52. Above the pipe 58 there is provided an air exhaust port 59 and at the side thereof there is provided an overflow liquid discharge pipe 60. The opposite lower portions of the cooling water chamber 52 and the opposite portions of the liquid tank 39 are connected by circulating pipes 62, each having a check valve 61 to prevent back-flow of liquids from the liquid tank 31. In the drawings, the reference numeral 63 designates an air cushion chamber located above an overflow opening 56 in the liquid containing internal cylinder 41, 64 a piston rod reciprocated by means of a suitable mechanism, 65 a flow control valve mounted on a circulating pipe 62, 66 a separating plate mounted in the cooling water chamber 52, 67 an insulated material for the cooling water chamber 52 and liquid tank 39, and 68 a support frame for the intake valve 47.

With the above-mentioned construction of the present invention, when the respective air intake port 36 is connected, for example, with the food vacuum drying chamber to be vacuumized, and the piston rod 64 is driven to allow the piston 40 to achieve lateral reciprocation, the liquids within the pair of left and right liquid containing external cylinder 35 and liquid containing internal cylinder 41 are alternately sucked and discharged through the respective intake valve 47 and exhaust valve 46 by the suction and exhaust action of the liquid tank 39 to suck and deaerate the air.

That is, for example, when the piston 40 is slidably moved from the position shown in FIG. 5 to left, the liquid in the right-hand liquid containing external cylinder 35 is sucked into the liquid tank 39 by the opening of the intake valve 47 due to suction. Air (saturated vapor)

is thus sucked through the air intake port 36 and cooled by the heat exchanging spiral fins 41' thus sucking apart thereof as water drops. At the same time, the exhaust valve 46 of the liquid containing internal cylinder 41' is maintained in a closed condition due to the suction pressure of the piston 40.

In the left-hand liquid containing external cylinder 35, the exhaust valve 46 of the exhaust cylinder 42 is opened at the same time when the intake valve 47 is closed due to the increase in liquid pressure within the liquid tank 37 to cause the liquid in the liquid tank 39 to the left of the piston 40 to be discharged into the liquid containing internal cylinder 41. The air discharged into the cylinder 41 enters the separating chamber 51 through the overflow opening 56 and passes through the cooling water chamber 52 through the air discharge opening 55 and is thence discharged through the air exhaust port 59. This cycle of operation may be repeated to suck air, alternately through the pair of left and right air intake ports 36 and to be deaerated at the air exhaust port 59. The liquid over-flown into the separating chamber 51 stays at the bottom of the separating chamber 51 to raise the opening-and-closing valve 54 via floater 53, to close the air discharge opening 55 and to elevate the pressure within the separating chamber 51. This elevated pressure forces the liquid at the bottom of chamber 51 to be returned to the cooling water chamber 52 through the discharge liquid pipe 57. When the level of the liquid is lowered, the opening-and-closing valve 54 having a floater 53 causes the air discharge opening 55 to open thereby discharging air upwardly of the cooling water chamber 52. During the suction stroke of the piston 40, the circulating pipe 62 causes the cooled liquid in the cooling water chamber 52 to suck into the liquid tank 39 via the check valve 61 to circulate and cool the liquid. During the exhaust stroke of the piston 40, the check valve 61 serves to prevent a backflow thereof. The air cushion chamber 63 located above the liquid containing internal cylinder 41 is to prevent water hammering at the time of the exhaust stroke because the cooled liquid is introduced into the liquid tank 39 through the circulating pipe 60.

Figure 8:
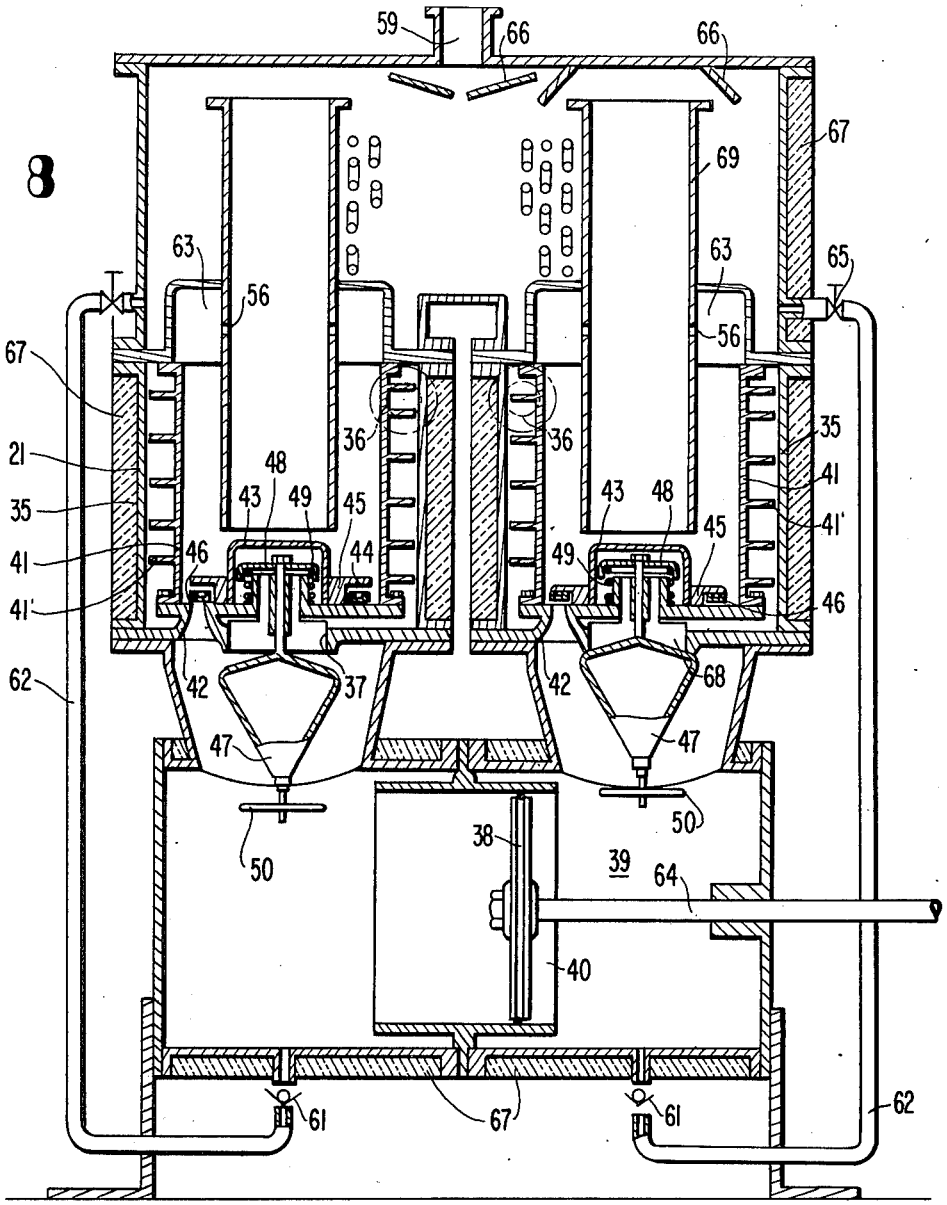
FIG. 8 illustrates a still another embodiment partially modified of FIG. 5.

FIG. 8 shows a modified form of the air separating chamber 51 shown previously in FIG. 5. The modified separating cylinder 69 has open upper and lower ends. Liquids that may be used in the present invention may include water, a mixture of water and ethylene glycol, ethylene glycol, oil, etc. Preferably, a cooling water spraying chamber may be provided frontwardly of the air intake port in order to rapidly cool and heatexchange suction air (saturated vapor).

While the operation of the pump according to the present invention has been explained in the case the pump is used as a vacuum pump, it is to be understood that the pump may of course be used as a compression pump by using the former in a reversed manner.

In the following, an example of the pump according to the present invention, which is applied to vacuum treatment of food or the like, will be discussed.

Figure 9:
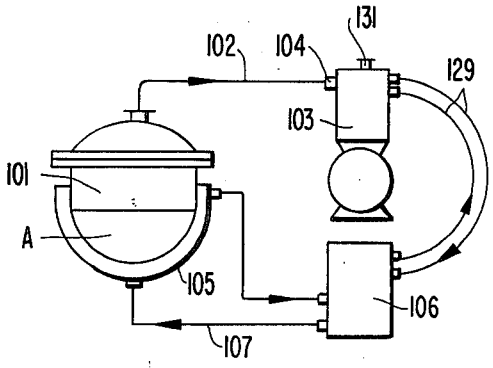

Turning now to FIG. 9, which illustrates one embodiment incorporating the pump according to the present invention, there is shown a treating container 101 having an upper portion connected through a pipe 102 to a suction port 104 of a vacuum pump according to the present invention. A heat exchanger device 105 in the form of a double oven is provided at the bottom thereof. A freezer 106 is circulatively connected by the pipe 107 to the double oven portion of the heat exchanger device 105 in the treating container 101 to circulate and utilize waste and hot water or air from the freezer 106 for purposes of heat exchanging in the treating container 101.

With the construction as noted above, when the vacuum pump and freezer 106 are driven and with food or the like at A to be fried or condensed received within the treating container 101, air within the treating container 101 is partly liquidized to be sucked and exhausted by suction and exhaust action of liquids in the vacuum pump 103, and the liquid in the vacuum pump is cooled and circulated passing through the freezer 106, and waste and hot water or air in the freezer 106 is introduced and circulated in the heat exchanger device 105 in the treating container 101 so that it may be utilized as a heat source of the treating container 101.

Figure 10:
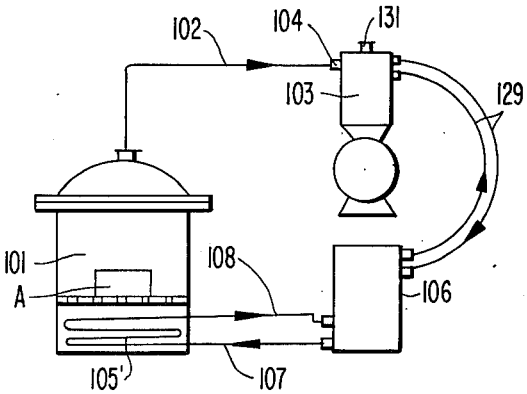

FIG. 10 shows an embodiment, in which the present invention is applied to a treatment for defreezing food, wherein a heat exchanger device 105', in the form of a bellow-like pipe, is mounted at the bottom of a hot water containing treating container 101, and a frozen product A is placed on the shelf 108, after which the treating container 101 is interiorly deaerated and vapor at a low temperature is generated, latent heat of which is condensed at the surface of the frozen product A for heat exchanging, whereby defreezing may be achieved at a low temperatue under vacuum.

As for liquids used with the vacuum pump according to the present invention, in the case of water, the water temperature is 3 to 5° C. and the vacuum is 6 to 5 mm of mercury column residual pressure; in the case of liquid comprising 10 to 20% of ethylene glycol mixed into water, water temperature may be decreased to −5° to −15° C. to thereby elevate the degree of the vacuum; and in the case of using ethylene glycol or oil, the circulating liquid at a temperature of from −20 to −30° C. may be produced to provide approximately complete degree of vacuum.

Further, an additional heating device may be incorporated in the treating container 101 as necessary.

Figure 11:
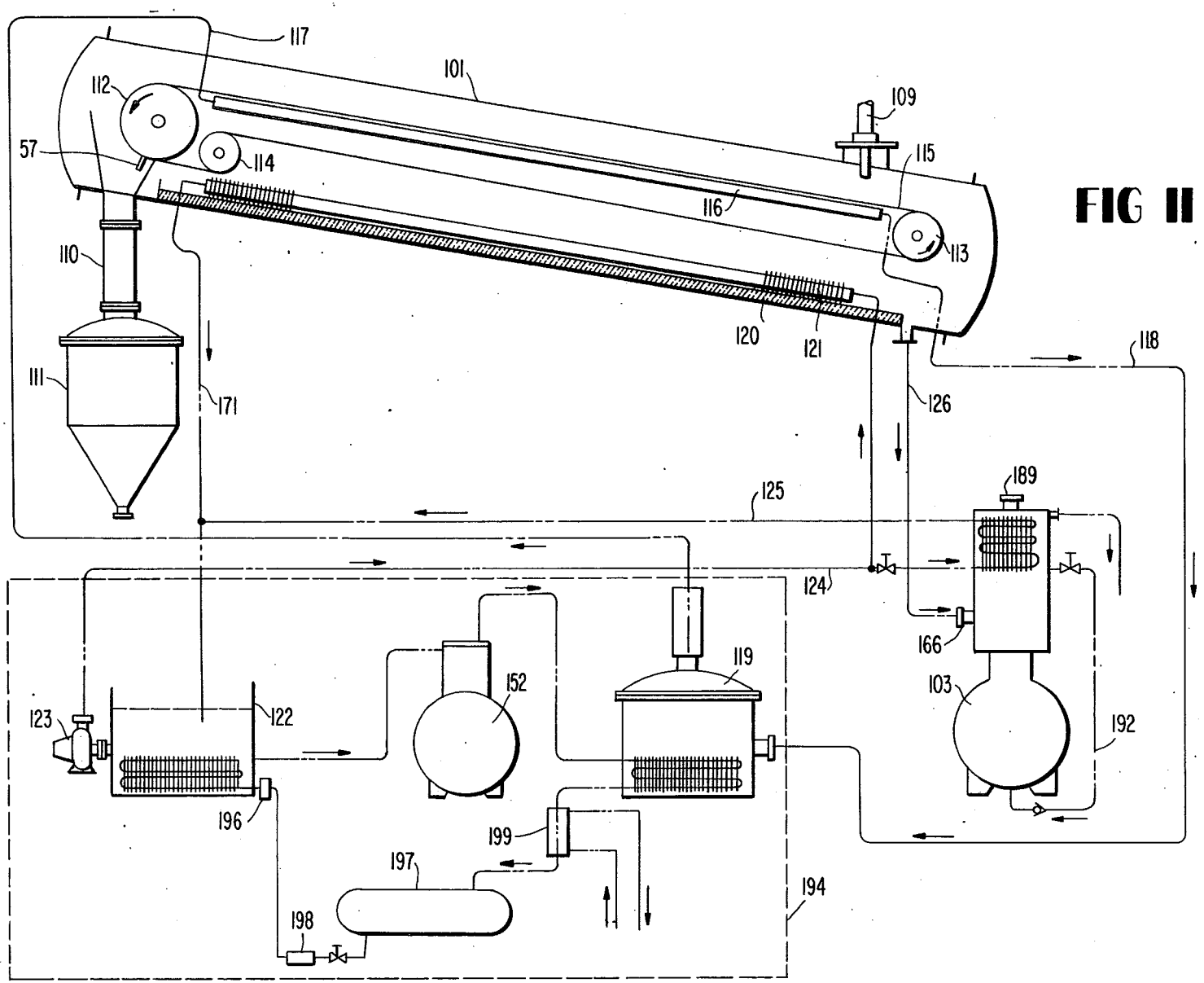

In FIG. 11, a cylindrical treating container 101, which is closed and which has its leading end slightly downwardly inclined, is provided with a raw material supply pipe 109 at the upper part on one end thereof and a discharge cylinder 110 on the other end thereof. The raw material supply pipe 109 is connected to a suitable raw material supply device not shown, and the discharge cylinder 110 is connected to a product containing tank 111.

Within the treating container 101, an endless conveyer belt 115 of about 0.1 to 0.05 mm in thickness made of a heat conductive material such as stainless steel, aluminum and the like is stretched over a drive roll 112, a follower roll 113, and a tension roll 114, whereby when the drive roll 112 is driven, the raw material sprayed or coated on the belt 115 from the raw material supply pipe 109 is continuously transported toward the discharge cylinder 110. A hollow heat exchanger device 116 is mounted in contact with the undersurface corresponding to a raw material transport passage of the endless conveyor belt 115.

This heat exchanger device 116 is connected with a heating medium supply device 119 by means of a heating medium supply pipe 117 and a discharge pipe 118 so that the raw material on the conveyor belt 115 may be heat-exchanged by heat conduction of the heating media such as heating water or vapor. The waste heat from the heating means 119 may be utilized as a heating medium for a heat source of the heat exchanger 116 of the vacuum vessel.

At the bottom portion of the treating container is mounted an insulated material 120, on which a cooling heat exchanger 121 composed of fin pipes is mounted. This cooling heat exchanger device 121 is connected by a transport pipe 124 with a cooling liquid supply device 122, for example, such as a cooling water tank. A pump 123 is used to feed the cooling water to the front end of the cooling heat exchanger device 121 thereby cooling the vapor emitted from the raw material to be re-condensed into liquid and returned to the cooling liquid supply device 122 or cooling tank via a return pipe 171 at the rear end of the cooling heat exchanger device 121 to allow the already heat-exchanged cooling water to be circulated.

The lower portion at the front end of the treating container 101 is connected by a suction pipe 126 with the vacuum pump 103 to suck the liquid vaporized and condensed from the raw material and at the same time to subject the treating container 101 to deaeration and suction. The vacuum pump is shown generally at 103.

Figure 12:
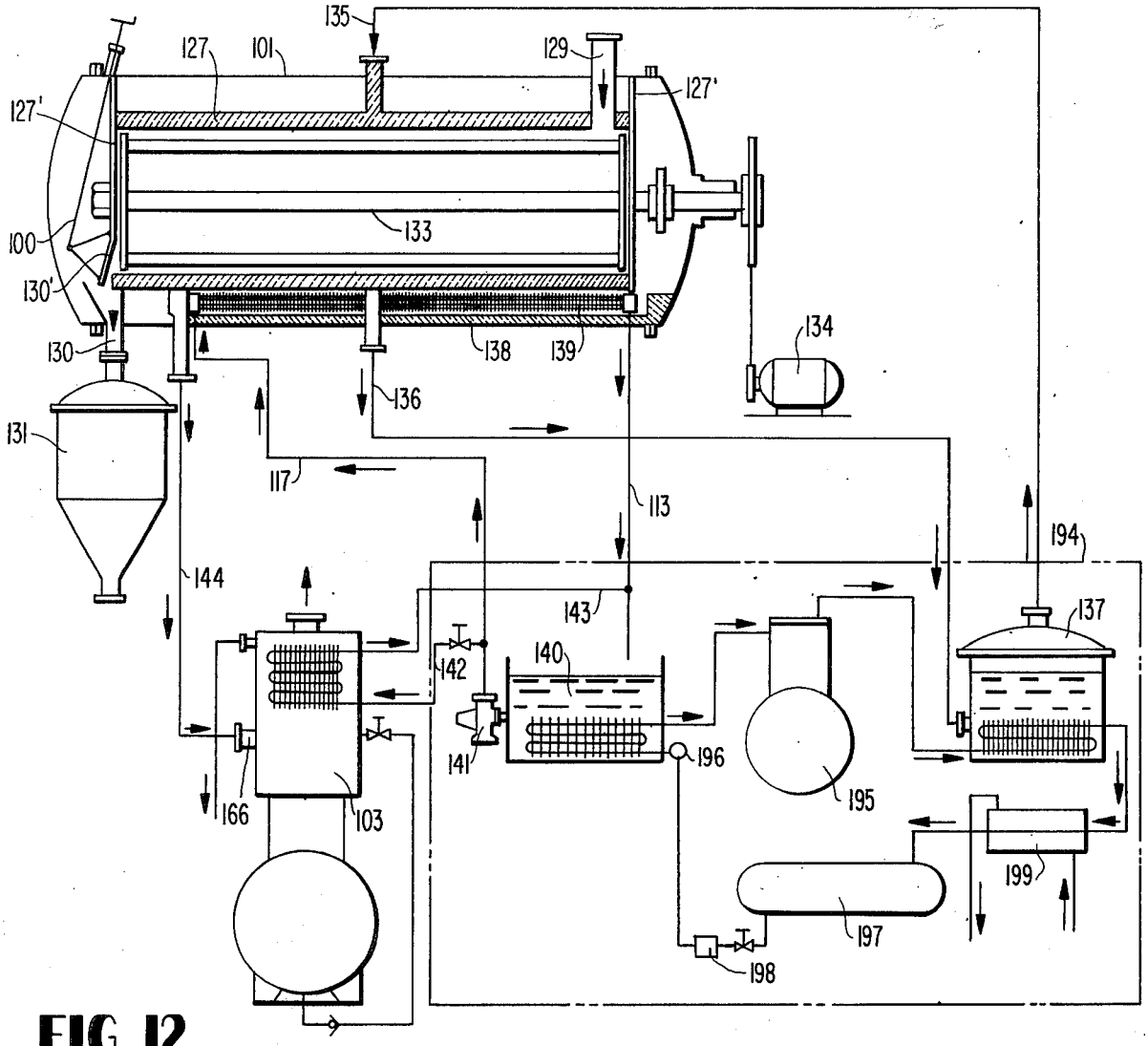
Figure 13:
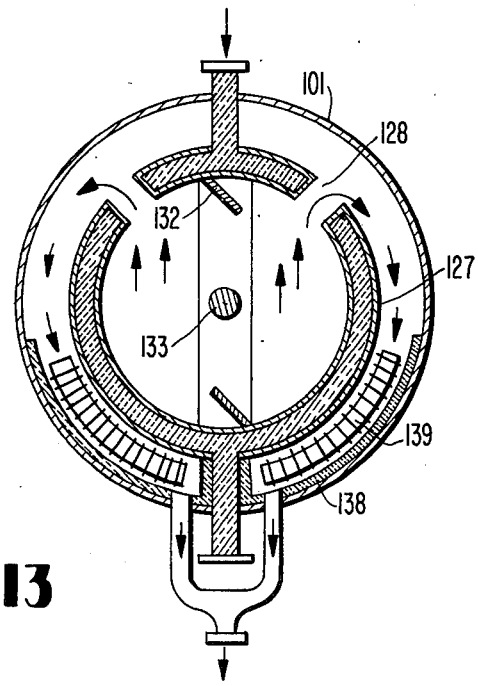

In FIGS. 12 and 13, a closed cylindrical treating container 101 is interiorly provided with a heat exchanger drum 127 of which opposite ends are closed by side plates 127', and wall surfaces are in the form of a double hollow configuration. This heat exchanger drum 127 has a vapor and gas emitting port 103 in the upper peripheral surface thereof, a raw material supply cylinder 128 at the upper part on one end thereof, and a raw material discharge cylinder 130 mounted through an opening-and-closing cover 130' at the side plate 127' portion on the other end thereof, the raw material discharge cylinder 130 being connected to a product containing tank 131.

The heat exchanger drum 127 has side plates 127', on which is rotatably supported a rotary shaft 133 of an agitating transport blade 132 in sliding contact with the inner peripheral surface of the heat exchanger drum 127. The rotary shaft 133 extends outwardly of the treating container 101 and is connected to an agitating motor 134.

The heat exchanger drum 127 has a hollow portion between the walls thereof connected to a heating medium supply pipe 135 in the upper central portion and is connected to a discharge pipe 136 in the lower central portion. The heating medium supply pipe 135 and the discharge pipe 136 are connected to a heating medium supply device 137 to circulate heating media such as heating water, vapor or the like, by heat conduction so that articles to be treated within the heat exchanger drum may be heat-exhanged.

Thus, in the case of FIGS. 12 and 13, the waste heat from the heat exchanger of the freezer may be utilized as a heating medium for a heat source of the heating medium supply device 137 of the vacuum vessel.

At the bottom portion of the treating container 101 is mounted an insulated material 138, on which a cooling heat exchanger device 139 composed of fin pipes is mounted. This cooling heat exchanger device 139 is connected by a transport pipe 124 with a cooling liquid supply device 140, for example, such as a cooling water tank utilizing a vaproizer of the freezer through a pump 141 to feed the cooling water to the rear end of the cooling heat exchanger device 139 thereby cooling the vapor emitted from the raw material to be recondensed into liquid, and the liquid is returned to the cooling liquid supply device 140 or cooling tank via a return pipe 113 at the front end of the cooling heat exchanger device 139 to allow the already heat-exchanged cooling water to be circulated.

The lower portion at the rear of the treating container 101 is connected by a suction pipe 144 with the vacuum pump 103 to suck the liquid vaporized and condensed from the raw material and at the same time the treating container 101 being interiorly subjected to deaeration and suction.

In FIGS. 14 and 15, a closed treating container 101, having an upper portion formed into a cylindrical configuration and lower portion into a conical configuration, has a raw material discharge outlet 145 located at the lower conical end connected to a product containing tank not shown. A hollow rotary shaft 147 driven by a motor 146 is provided the center of the cylindrical portion. To the upper end of the hollow portion of the rotary shaft 147 is connected a liquidstate raw material supplying pipe 148 whereas to the lower portion thereof is extended a spray nozzle 149. A scraper plate 150 is mounted on the rotary shaft 147 with a displacement of 180° from the spray nozzle 149, as viewed from the drawing.

A heat exchanger drum 151, which is formed with two layers of inner and outer hollow portions by a partition plate 151' so that upper portions thereof may come into communication, is mounted on a portion of the treating container 101 where the scraper plate 150 is placed in sliding contact. The lower portion of the outer layer and the lower portion of the inner layer are connected to a heating medium supply device 155 by means of a heating medium supply pipe 153 and a discharge pipe 154 through annular connection pipes 152, 152', respectively, whereby the raw material sprayed against the inner peripheral surface of the heat exchanger drum 151 may be heat-exchanged by heat conduction of heating media such as heating water or vapor.

Thus, the waste heat from the heat exchanger of the freezer may be utilized as a heating medium for a heat source of the heating medium supply device 155 of the vacuum vessel.

On the inner peripheral surface of the treating container 101 there is mounted an insulated material 156, and within the container there is mounted a cooling heat exchanger 157 composed of fin pipes adjacent the heat exchanger drum 151. This cooling heat exchanger device 157 is connected by a transport pipe 160 with a cooling liquid supply device 158. The latter may be a cooling water tank utilizing a vaporizer of the freezer through a pump 159 to feed the cooling water to the lower portion of the cooling heat exchanger device 157 thereby cooling the vapor emitted from the raw material to be re-condensed into liquid. The liquid is returned to the cooling liquid supply device 58 or cooling tank via a return pipe 161 at the upper end of the cooling heat exchanger device 157 to allow the already heat-exchanged cooling water to be circulated.

One side at the lower portion of the cooling heat exchanger device 157 in the treating container 101 is connected by a suction pipe 163 with the vacuum pump 162 to suck the liquid from the raw material and at the same time to subject the treating container 101 to deaeration and suction.

What is claimed is:

1. A liquid-sealed type vacuum pump comprising, at least one liquid containing cylinder having a liquid therein, said liquid containing cylinder including a chamber portion therein adapted to be vacuumized when the pressure of said liquid is reduced, a suction means adapted to be connected to an external device for evacuating said external device, and connected at the other end to said cylinder, a liquid tank connected to said liquid cylinder and pressure means in said liquid tank for alternately increasing and decreasing the pressure of said liquid in said liquid containing cylinder, valve means in said liquid containing cylinder for discharging said liquid when under high pressure and for admitting air from said suction means when said liquid is under lower pressure, means coupled to said suction means and to said cylinder for returning at least part of said discharged liquid to said cylinder for effectuating a stabilized suction and discharge operation, and fluid cooling means positioned with respect to said suction means and said liquid containing cylinder for cooling and liquidizing the air admitted via said suction means.

2. A liquid-sealed type vacuum pump as claimed in claim 1 characterized in that said liquid containing cylinder comprises an internal cylinder and an external cylinder, said internal cylinder and said external cylinder being connected to said liquid tank by said valve means, said suction means being brought into communication with said external cylinder, and wherein said valve means comprises a first valve arrangement for passing liquid and air from said external cylinder to said liquid tank thereby permitting the reduction of pressure to cause air to enter said external cylinder and flow through said first valve arrangement to said liquid tank, and a second valve arrangement for passing liquid and air from said liquid tank to said internal cylinder to result in the discharge of said air.

3. A liquid-sealed type vacuum pump according to claim 2 wherein said first valve arrangement comprises a pressure responsive intake valve at the juncture of said liquid tank and said liquid containing cylinder, said intake valve being formed of a floating material and having a flow pressure plate in said liquid tank for controlling the opening and closing of said valve when said pressure is low and high, respectively.

4. A liquid-sealed type vacuum pump according to claim 3 wherein said valve means further comprises a chamber connected to the upper part of said internal cylinder for receiving air and over flow liquid from said internal cylinder, a normally open valve at the top of said chamber for discharging the air in said chamber when open, a float member connected to said valve and extending to the lower end of said chamber for closing said normally open valve when the liquid in said chamber rises above a certain level, a pipe connected at its lower end to the lower part of said chamber and being open at its upper end, whereby the increased air pressure resulting when said valve is closed forces liquid through said pipe.

5. A liquid-sealed type vacuum pump as claimed in claim 4 further comprising a cooling chamber surrounding said liquid-containing cylinder, said last mentioned pipe and said normally closed valve opening into said cooling chamber, and wherein said means for returning at least part of said discharged liquid includes a pipe connected between said cooling chamber and said liquid tank, said pipe having a one-way valve connected thereto to insure that liquid does not flow from said tank to said chamber.

6. A liquid-sealed type vacuum pump as claimed in claim 5 further comprising a refrigeration means in said cooling chamber.

7. A liquid-sealed type vacuum pump as claimed in claim 3 further including heat exchanging spiral fins mounted on an external wall of said internal cylinder so as to extend into said external cylinder for cooling and liquidizing vapor sucked into said external cylinder.

8. A liquid-sealed type vacuum pump as claimed in claim 3 wherein said pressure means comprises a cylinder and a reciprocating piston therein.

9. A liquid-sealed type vacuum pump as claimed in claim 8 wherein there are two substantially identical liquidcontaining cylinders with substantially identical valve means, said two cylinders being connected to said liquid tank at opposite ends of said pressure means so as to alternately suck air in and discharge air and liquid therefrom.

10. A liquid-sealed type vacuum pump as claimed in claim 1 wherein said liquid containing cylinder comprises an internal cylinder and an external cylinder, and wherein said suction means comprises a suction cylinder external to said external cylinder.

11. A liquid-sealed type vacuum pump as claimed in claim 10 wherein said valve means comprises a first valve arrangement at the top of said liquid containing cylinder, where said internal and external cylinders open to one another, for discharging liquid and air therefrom when said liquid is under high pressure, and a second valve arrangement interconnecting said suction chamber and said external chamber at the bottom portions thereof to cause air in said suction chamber to be sucked through said second valve arrangement when said liquid is at low pressure.

12. A liquid-sealed type vacuum pump as claimed in claim 11 further comprising a refrigerating coil in said external chamber and heat exchanging fins in said suction chamber, both being adapted to cool and liquidize air as is flows downward in said suction chamber and upwards in said external chamber.

13. A liquid-sealed type vacuum pump as claimed in claim 12 wherein said pressure means comprises a cylinder having a reciprocating piston therein, and wherein there are two substantially identical liquid containing chambers, suction chambers and valve means, each connected to an opposite side of said pressure means to alternately suck in air and discharge air and liquid.

* * * * *